United States Patent [19]

VanderVaart

[11] 4,441,546

[45] Apr. 10, 1984

[54] METHOD OF OPERATING A HEAT-AUGMENTED HEAT PUMP SYSTEM

[75] Inventor: Gerry VanderVaart, Niagara Falls, Canada

[73] Assignee: Kool-Fire Limited, Niagara Falls, Canada

[21] Appl. No.: 259,357

[22] Filed: Apr. 30, 1981

Related U.S. Application Data

[62] Division of Ser. No. 54,647, Jul. 3, 1979, Pat. No. 4,311,191.

[51] Int. Cl.[3] ..... F25B 29/00

[52] U.S. Cl. ..... 165/29; 165/64; 62/276; 62/238.7; 62/324.5

[58] Field of Search ..... 165/29, 62, 63, 64, 165/122; 62/238.6, 238.7, 324.5, 276; 237/2 B

[56] References Cited

U.S. PATENT DOCUMENTS

| | | | |
|---|---|---|---|
| 2,619,812 | 12/1952 | Burgess | 165/29 |
| 2,759,708 | 8/1956 | Burgess | 165/29 |
| 2,780,445 | 2/1957 | Rimbach | 165/124 |
| 3,135,317 | 6/1964 | Goettl | 165/29 |
| 3,157,227 | 11/1964 | Palmer | 165/29 |
| 3,831,670 | 8/1974 | Mullings | 165/124 |
| 4,012,920 | 3/1977 | Kirschbaum | 62/238.7 |
| 4,055,963 | 11/1977 | Shoji et al. | 62/238.6 |
| 4,112,705 | 9/1978 | Sisk et al. | 165/29 |
| 4,141,490 | 2/1979 | Franchina | 237/2 B |
| 4,187,687 | 2/1980 | Savage | 237/2 B |
| 4,302,942 | 12/1981 | Charters et al. | 237/2 B |

*Primary Examiner*—William R. Cline
*Assistant Examiner*—John M. Kramer
*Attorney, Agent, or Firm*—Diller, Ramik & Wight

[57] ABSTRACT

This disclosure relates to a heat exchanger which includes an A-coil through which a heat-exchange medium (refrigerant) is circulated between an inlet and an outlet thereof, a compressor in fluid communication with the outlet for compressing a vapor phase of the heat-exchange medium, and means for generating heat beyond and as an augment to ambient temeprature sufficient to transform the liquid phase of the heat-exchange medium to its vapor phase during the passage of the heat-exchange medium from the inlet to the outlet with substantially total absorption of the heat by the heat-exchange medium for subsequent extraction of the heat from the vapor phase to effect desired heating.

4 Claims, 5 Drawing Figures

METHOD OF OPERATING A HEAT-AUGMENTED HEAT PUMP SYSTEM

This is a division of application Ser. No. 054,647 filed July 3, 1979, now U.S. Pat. No. 4,311,191.

The heat exchanger of this invention will be best understood by first considering a conventional heat pump which in its heating mode absorbs heat from outside a building and delivers it inside and vice versa to effect cooling of the interior of an associated building by discharging heat exteriorly thereof.

In order to effect heating by utilizing a conventional heat pump, a heat-exchange medium, such as relatively cold Freon, first flows through coils that are exposed to exterior ambient temperature (outside air). The heat-exchange medium absorbs heat from the outside air and flows through a compressor which increases its temperature and pressure. The refrigerant then flows a conventional interior utilization device, such as another heat exchanger in the form of a heat-exchange coil which essentially resembles an automobile radiator, and gives up its heat to room air which is circulated by a fan or similar conventional means through the interior heat exchanger. The refrigerant then passes through an expansion and/or reversing valve that lowers its pressure and, hence, results in a drop in temperature. The cycle is repeated as the refrigerant circulates again through the coils exteriorly of the building, and again absorbs heat from the lower temperature outside air source.

In the cooling mode of operation of the heat pump, the valve reverses the direction of the refrigerant flow and the refrigerant in its vapor or vapor phase flows at a high temperature and pressure through the coils outside the building exposed once again to ambient or air temperature. The air absorbs the heat from the hotter refrigerant which, of course, takes place even though the outside air is warmer because the latter is still cooler than the refrigerant. The refrigerant then passes through the expansion/reversing valve which lowers its pressure, thus, decreasing the temperature. In the interior or utilization heat exchanger, again likened to an automotive radiator, the refrigerant absorbs heat from the room air which again is circulated through the coils thereof, resulting in interior cooling. The refrigerant then returns to the compressor and the cycle is then repeated. Obviously, such conventional heat pumps are controlled by thermostat circutry that sense the temperature externally, internally, etc., and regulate the various modes of operation depending upon whether the interior of the building ought be heated or cooled.

A known major disadvantage of conventional heat pumps is their progressive reduction in efficiency when operated in the heat mode thereof in cool or cold climates because, quite simply, less heat can be absorbed from cold exterior air than from relatively warmer exterior air. As a result, most manufacturers utilize some type of supplementary or add-on electrical heaters which are installed in the duct work of conventional forced air or hot air systems. Alternately, conventional heat pumps are simply not used when the outside temperature drops to 30°-32° F. or below, and in lieu thereof the standard electric, oil or gas home furnace is utilized with the heat pumps being essentially functionless for a considerable period of time or, if not functionless, operating in extremely low efficiency over a long period of time in cool or Northern climates.

In keeping with the foregoing, the novel heat exchanger of the present invention operates generally identically to a conventional heat pump during its heating and cooling modes but, in addition, includes a third mode of operation which renders the heat exchanger or heat pump of the invention fully operative at temperatures well below those which would render conventional heat pumps virtually totally inoperative and/or inefficient during their heating mode of operation. For lack of more descriptive phraseology, the present invention is directed to a heat exchanger or heat pump which is capable of operating in a "heat-augmenting mode" when outside temperatures are sufficiently low so as to preclude any or reasonably efficient operation of conventional heat pumps.

The apparatus which achieves the "heat-augmenting mode" operation of the novel heat exchanger of this invention is the utilization of means for generating heat to augment relatively low ambient temperature sufficient to transform the liquid phase of a refrigerant (heat-exchange medium) located in a coil exterior of a building to be heated to its vapor phase which would otherwise be impossible under low ambient air temperature conditions with a result that the heat thus absorbed can be further increased in temperature and pressure by a conventional compressor and subsequently utilized through another heat exchanger interiorly of a building to heat the same. More specifically, the heat generating means is simply a gas, electric, steam, or an equivalent source of heat preferably disposed adjacent the bottom of an "A-coil" located at the exterior of a building which is to be heated whereupon the liquid phase of the refrigerant, which is preferably introduced into the bottom of the A-coil, is transformed to its vapor phase during the passage thereof to the A-coil and the heat thus absorbed from the heat generating means can be subsequently extracted interior of the building to effect desired heating.

Another and perhaps relatively simple manner of understanding the present invention is to recognize that the exterior coil of a conventional heat pump exposed to outside air temperature does not "know" whether such outside air temperature is hot, cold or in between. In conventional heat pumps, an indoor thermostat is used, for example, to sense the indoor temperature and at perhaps 60° F. will "tell" the heat pump that more heat is required internally of the building, house, or the like, at which point irrespective of the outdoor temperature, the heat pump will operate in its conventional heating mode. If the temperature outside is extremely cold, this, once again, is not known to the heat pump, it operates, and either the operation is inefficient or the heat pump will, in fact, fail to operate because a liquid refrigerant can not be transformed into its vapor state which is a necessary prerequisite for its operation.

Contrary to the latter-described conventional heat mode operation of a heat pump, the present heat pump or heat exchanger in its "heat augmenting" mode of operation does not "know" and more importantly could not care less as to what the outside temperature might be, so long as at any cool or cold outside air temperature, the A-coil is supplied additional heat or, stated otherwise, the heat which the A-coil can absorb from ambient air is augmented by heat added directly thereto resulting in the transformation of the refrigerant from its liquid to its vapor phase with attendant absorption (approximately 94 percent) of the total heat (supplemented and ambient) which eventually is utilized for indoor heating. In this manner, it makes virtually no difference how cold it might be outside so long as sufficient heat is supplied to the A-coil to render the heat exchanger highly efficiently operative under extremely low ambient outside air temperature.

The heat exchanger of this invention is, of course, capable of operating in the "normal" heating and cooling modes of a conventional heat pump or heat exchanger, but the invention is specifically directed to the structure which effects "the heat-augmenting mode" of operation which will be described immediately hereinafter with reference to the following drawings in which.

Figure 3:
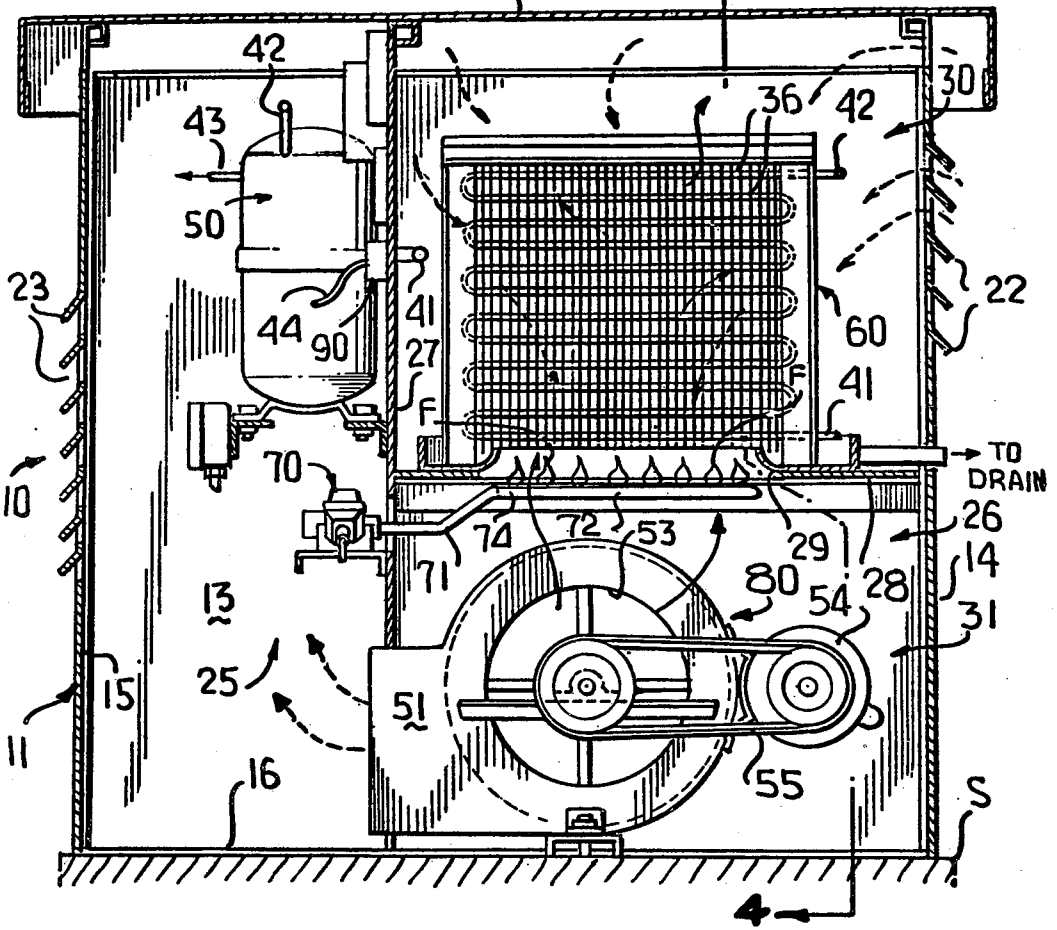
FIG. 3 is a longitudinal sectional view taken generally along line 3—3 of FIG. 2 and illustrates details of the heat exchanger housing including the location of the source of heat adjacent bottom portions of the legs of the A-coil.
Figure 4:
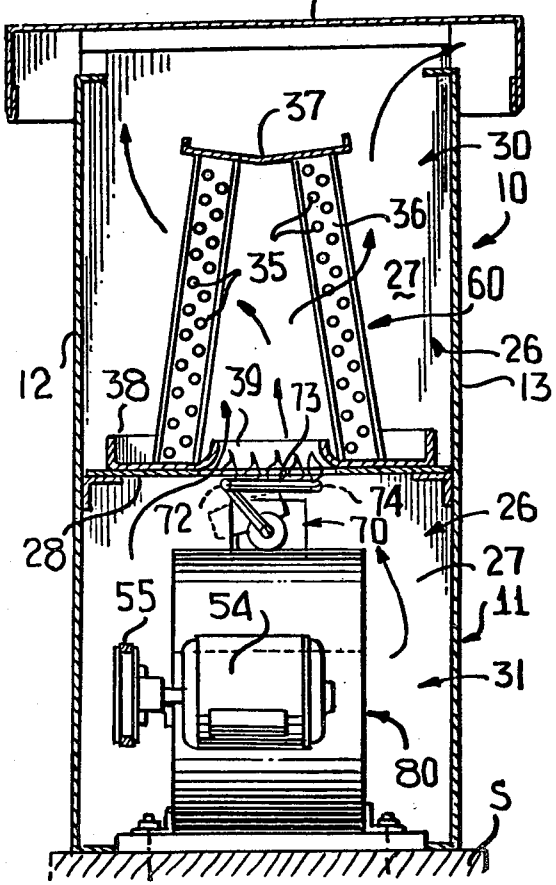
Figure 5:
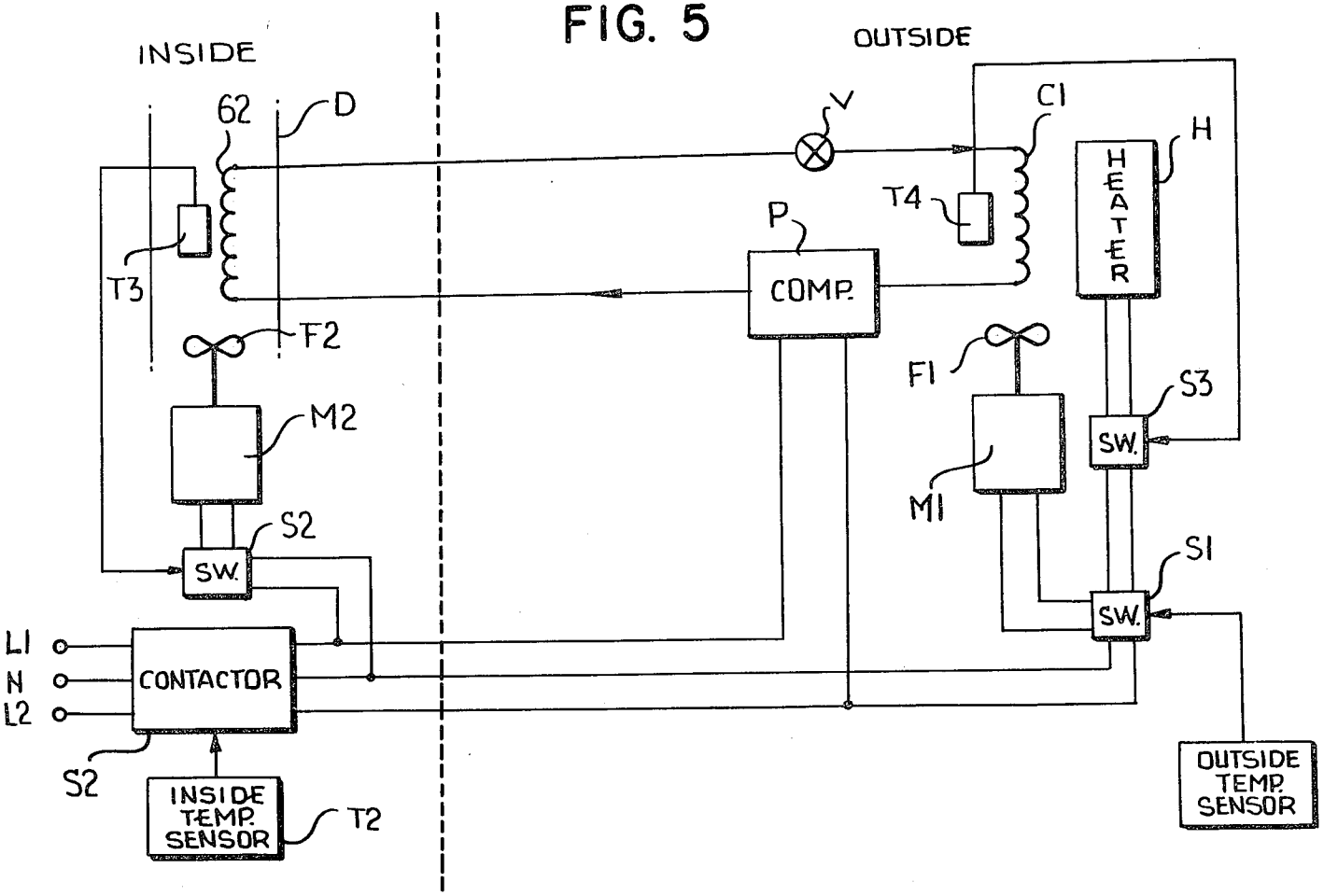

FIG. 4 is a sectional view taken generally along lines 4—4 of FIG. 3 and illustrates the manner in which hot air rises within and through the absorber fins and about the coils of the A-coil during the heat-augmented mode of operation of the heat exchanger; and FIG. 5 is an electrical schematic view and illustrates the electrical system for operating the heat exchanger in an automatic manner including an ambient temperature sensor to automatically control the gas burner or the like at selected low ambient air temperature conditions.

Reference is now made to FIGS. 1 through 4 of the drawings in which a novel heat exchanger of heat-augmented heat pump is generally designated by the reference numeral 10 and includes a housing 11 defined by a front wall 12, a rear wall 13, end walls 14, 15, a bottom wall 16 seated upon a concrete slab S, and a top wall or cover 17. The cover 17 is preferably hinged (not shown) to an upper edge portion of the rear wall 13 so that ample access to the interior of the housing 11 is provided from above when the cover 17 is in its open (not shown) position. Likewise, the end walls 14, 15 are removably secured by sheet metal screws (not shown) to the walls 12, 13 so that the end walls 14, 15 can be readily removed, thus, providing ample access to interior components of the heat exchanger 10.

The height of the walls 12, 13 is less than the total height of the end walls 14, 15, as is readily apparent in FIG. 1, and the end walls 14, 15 are relieved at 20, 21, respectively, as well as being provided with baffled vents or openings 22, 23, respectively (FIGS. 1 and 3) in order that air might readily circulate through the housing 11 in a manner to be described more fully hereinafter.

The housing 11 is also separated into a pair of chamber means or chambers 25, 26 by a vertical partition or wall 27 while a horizontal partition or wall 28 having a central opening 29 (FIG. 3) separates the chamber 26 into an upper chamber portion 30 and a lower chamber portion 31 (FIG. 3). The construction of the housing 11 and particularly the manner in which the same has been partitioned results in highly efficient air flow as well as increased noise damping characteristics, as will be more evident hereinafter. Furthermore, all of the electrical components of the electrical system 40 (FIG. 5) are located in the chamber 25 whereat they will be unaffected by moisture, condensation, or the like which will occur in the upper chamber portion 30 of the chamber 26. The exact location of the various components of the electrical circuit 40 in the chamber 25 is of no particular importance insofar as the present invention is concerned and are thus not illustrated in any of FIGS. 1 through 4 of the drawings.

The major components of the heat exchanger 10 of the invention include compressor means 50, and A-coil 60, and means 70 for providing a heat source to augment the temperature of outside ambient air. In addition to the latter-noted major components, the heat exchanger includes a blower 80 and a reversing/expansion valve 90.

Figure 2:
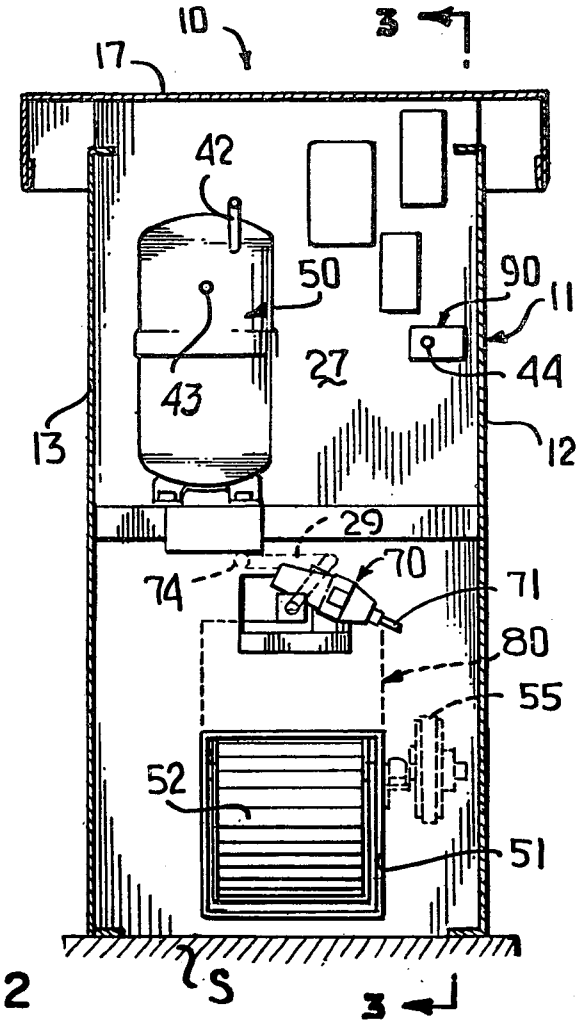
FIG. 2 is a sectional view taken generally along line 2—2 of FIG. 1 and illustrates additional details of the heat exchanger including a heat source, such as a natural gas burner, for augmenting the heat absorbed from ambient air by the A-coil.
Figure 1:
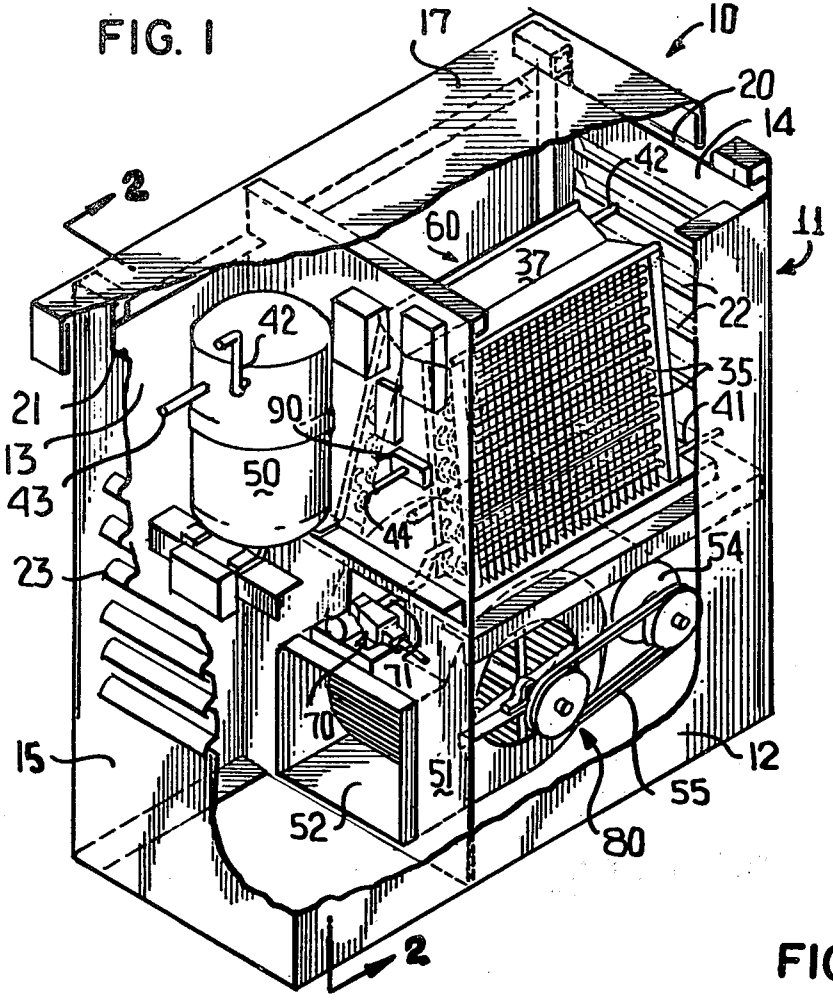
FIG. 1 is a fragmentary perspective view of a novel heat exchanger of the present invention and illustrates an A-coil, a blower, an associated compressor and an associated housing.

Reference is made specifically to FIGS. 1, 3 and 4 of the drawings wherein the A-coil 60 is fully illustrated and is a conventional off-the-shelf item which in transverse cross-section is generally of an inverted V-shaped configuration (FIG. 4) defined by a pair of interconnected coils 35 which are coiled through metalic heat-conductive fins 36. An upper end portion (unnumbered) of the A-coil 60 is covered by a removable metalic plate 37 while bottom end portions (unnumbered) of the A-coil 60 rest upon a generally annular condensation collecting pan 38 having a central elongated opening 39 disposed adjacent the opening 29 of the horizontal partition or wall 28 (FIGS. 3 and 4). The coils 35 of the A-coil 60 include an inlet/outlet 41 (FIG. 3) and a bottom of each leg of the A-coil 60 and an inlet/outlet 42 at the top of each leg of the A-coil. The expression "inlet/-outlet" has been utilized herein simply to indicate that, depending upon the particular mode of operation of the heat exchanger, refrigerant will flow through the coils 35 in one direction at which the refrigerant will exit from the conduit 41 while in another mode, the refrigerant may enter the conduit 41, and the same is true of the conduit 42. Hence, the expression "inlet/outlet" merely refers to the direction of flow of the refrigerant, either in its liquid or vapor phase, with respect to the particular mode of operation of the heat exchanger 10, as will be more fully apparent hereinafter.

The inlet/outlet or conduit 42 is connected to the compressor 50 (FIG. 3) and a conduit 43 from the compressor 50 is connected to a heat exchanger within a building, such as a home, apartment, or the like which is to be heated or cooled. The "interior" heat exchanger or a similar heat utilizing device is of a conventional construction, thus is not illustrated but may simply be a coil such as the A-coil 60, though not necessarily of the same configuration. The conventional utilizing coil need only have air blown through it so that during the cooling mode, cold liquid refrigerant will absorb heat from the interior air resulting in a decrease in interior air temperature or alternatively when high temperature refrigerant vapor is passed though the utilization coil, the interior air passing through the coil absorbs the warm air and is thereby warmed in the heating mode.

The interior or utilizer coil is connected by an inlet/-outlet conduit 44 (FIG. 3) to the expansion/reversing valve 90 and the latter is connected to the inlet/outlet conduit 41. Thus, the flow circuit for the refrigerant, be it in its liquid, vapor or liquid/vapor phase is from the A-coil 60 through the inlet/outlet conduit 42 to the compressor 50 thence through the conduit 43 to the interior utilization heat exchanger followed by the inlet/outlet conduit 44, the reversing/expansion valve 90 and back to the bottom of the A-coil 60 through the inlet/outlet conduit 41.

The blower 80 includes a housing 51 having an outlet 52 opening into the chamber 25 and an inlet 53 opening into the chamber portion 26. The fan is driven by a conventional motor 54 through conventional pulleys, a pulley belt, and shafts, all collectively designated by the reference numeral 55 (FIG. 1). The motor 54 is energized during the operation of the heat exchanger 10 in its conventional cooling mode and its conventional heating mode, but not during its heat-augmenting mode in which air rises through the A-coil 60 by natural convection currents, as indicated by the headed, unnumbered arrows in FIGS. 3 and 4, and as will be described more fully hereinafter.

The heat source 70 for augmenting the ambient outside air temperature is illustrated as a natural gas burner 70 which includes an outlet burner or conduit 71 (FIG. 3) having a first leg 72 which runs along one side of the opening 39 (FIG. 4), a leg 73 transverse thereto (FIG. 4), and a return leg 74 (FIG. 4) which terminates in a blind end (not shown) adjacent the left hand edge of the slot 39, as viewed in FIG. 3. The legs 72 through 74 of the burner or conduit 71 have a plurality of openings which emit flames F when the natural gas is ignited by a conventional spark or like igniter.

The operation of the heat exchanger 10 will now be described with reference first to the conventional cooling and heating modes of operation, followed by the novel heat-augmenting mode of operation thereof:

HEATING MODE

In the heating mode of operation of the heat exchanger 10, the heat-exchange medium (a cold refrigerant such as Freon) first flows under the operation of the compressor 50 into the inlet conduit 41 at the bottom of the A-coil 60 and progressively absorbs heat from ambient air which is drawn into the upper housing portion 30, through the coils, into the inlet 53 of the blower, and outwardly from the outlet 52 of the pump into the chamber 25 during the energization of the pump with the latter-noted air flow being indicated by the dashed, unnumbered headed arrows in FIG. 3. At this point, the heat source 70 is totally unoperational and, therefore, the heat-exchange medium, as it moves through the coils 35 in an upward direction, absorbs heat only from ambient air which is drawn through the A-coil 60 in the manner just described. The progressive increase in temperature of the heat-exchange medium transforms the same into its low pressure vapor phase which is conducted via the outlet conduit 42 to the compressor 50 which further increases the pressure, thus the temperature, and the hot vapor phase of the refrigerant then flows through the conduit 43 to the interior heat exchanger (heat-exchange coil) through which air is blown absorbing the heat of the vapor phase refrigerant, heating the interior and, of course, progressively cooling the refrigerant which is returned to the reversing-/expansion valve 90 through the conduit 44 which in turn returns the now low pressure cold vapor phase and/or liquid phase of the heat-exchange medium to the bottom of the A-coil 60 whereafter the cycle is continuously repeated.

COOLING MODE

For cooling purposes, the expansion/reversing valve 90 simply reverses the direction of refrigerant flow and the latter is controlled, for example, in a conventional manner by the circuitry 40 including the thermostat thereof which can be set, as desired. In this manner, high pressure hot vapor refrigerant when pumped thorough the A-coil gives off its heat to the air flowing therethrough under the influence of the blower 80, and the high pressure cool vapor or liquid phase is transformed by the reversing/expansion valve to a lower pressure gas or liquid phase which when passed through the utilization coil in the building picks up or absorbs the heat blown through the utilization coils thereby cooling the room or building air after which the now lower pressure vapor phase is returned from the utilization device to the compressor.

HEAT-AUGMENTING MODE

In this mode of operation of the heat exchanger 10, the blower 80 is inoperative, and the operation and/or flow of the refrigerant, both as to its liquid and/or vapor phase, is identical to that heretofore described in the "heating mode" of the heat exchanger 10. However, it is to be understood that in the heat-augmenting mode of operation of the heat exchanger 10, ambient outside temperature is relatively low as, for example, 32° F. or below. The temperature sensor associated with the gas burner assembly of the electrical circuitry 40 of FIG. 5 senses a predetermined temperature (32° F.) and in response thereto (1) the blower 80 is de-energized to terminate the heating mode of operation, and (2) the heat source 70 or gas burner assembly is energized by igniting the gas resulting in the hot flames F which under natural convection, currents rise upwardly through the A-coil 60, as indicated by the headed unnumbered arrows in FIG. 3. The flames F are extremely small but are spread out substantially evenly across the bottom of the A-coil 60, as is most readily apparent in FIGS. 3 and 4 of the drawings. As the heat from the flames F rises, it first impinges under its maximum temperature against the coldest (bottom) coils and the liquid heat exchange medium therein with, of course, the refrigerant flowing through the coils 35 in a direction from the bottom of both of the legs of the A-coil 60 to the tops thereof. Due to this relationship, deterioration of the bottom coils 35 and the lower fins 36 is virtually precluded, and because there is the greatest temperature differential between the refrigerant in the lowermost coil and the flames F, a major amount of heat absorption takes place along the bottom of the A-coil 60 and progressively lessens in an upward direction since the liquid coil refrigerant progressively warms as it rises in the coils 35 until it is transformed into its vapor phase. Essentially, there is almost total heat absorption at the time that the vapor phase of the refrigerant exits the conduit 42 of the A-coil 60 and an essentially heat-free gas (from the flames F) escapes to atmosphere so that the burning process approaches 100 percent. It is to be noted that the flames F do not generate the totality of the heat necessary to transform the refrigerant from its liquid phase to its vapor phase as it passes upwardly through the coils 35 of the A-coil 60, but rather augments or adds to the heat which the refrigerant can absorb from the ambient air, even though the latter is relatively cold (32° F., again merely exemplary). Thus, it is totally immaterial to the operation of the heat exchanger 10 as to what might be the ambient air temperature, be it 32° F. or −24° F., etc. All that the heat exchanger "knows" is that there is sufficient heat available from the flames F, which when added to that of the ambient air temperature results in a high temperature differential between the total heat input and the temperature of the refrigerant resulting in a hot gaseous or vapor phase exiting the A-coil 60 through the outlet conduit 42 for suitable in-house heating purposes by the conventional utilization heat exchangers heretofore noted. Thus, the compressor 50 can utilize in an extremely efficient manner the relatively highly heated low pressure vapor phase of the refrigerant which would be totally impossible in the absence of the additive heat provided by the heat source 7. Efficiency is further increased by constructing the A-coil 60 of a size approximately twice that of the utilization coil within the building to be heated so that essentially all of the heat induced by the flames F in the refrigerant passing through the coils 35 of the A-coil 60 is absorbed, again along with absorbing the heat of the ambient air itself, resulting in extremely efficient heat-transfer and corresponding low operating costs as well as interior building comfort by virtue of high volume/-low temperature (approximately 105° F.) interior hot air flow. An example of the latter is evidenced by the following table which represents the total costs of heating a three-bedroom brick bungalow utilizing the heat-augmenting mode of operation of the heat exchanger 10 in Niagra Falls, Ontario, Canada, from October 1 through April 15. The home is occupied by five persons and the daytime temperature was maintained at 72° F. with the nighttime temperature being 68° F. The basement of this bungalow was maintained at an average temperature of 65° F. at all times.

| Month | Average Outside Temp. of | Energy Cost Elect. | Gas | Total |
|---|---|---|---|---|
| October | 47 | $4.25 | — | $4.25 |
| November | 37 | $11.57 | $8.88 | $20.45 |
| December | 27 | $16.31 | $19.94 | $36.25 |
| January | 19 | $19.73 | $25.18 | $44.91 |
| February | 12 | $18.09 | $23.71 | $41.80 |
| March | 34 | $11.30 | $13.23 | $24.53 |
| April 1-15 | 32 | $5.73 | $6.88 | $12.61 |
| Total Cost for Period | | $86.98 | $97.82 | $184.80 |

It is believed that the latter-noted recordation of an actual working embodiment of this invention indicates quite emphatically the extremely efficient and low-cost nature of the present invention and, of course, the ability of the invention to operate under outside ambient air temperature conditions which would render other heat pumps inoperative or require utilization of supplementary heat sources, such as electric heating coils which are installed in hot air ducts as practiced by such well-known heat pump manufacturers as York, Lennox, etc.

Another outstanding indication of the efficiency of the present invention is that in another home heated by a conventional gas furnace, the charges for the gas for the month of January, 1979 was $122.71 (Canadian). The same home was converted by the installation of the heat exchanger 10 of this invention and its operation for the same period of time (one month) in the heat-augmenting mode resulted in a gas bill of $43.80 (Canadian), and the latter charge was for the month of February which recorded the lowest temperatures not only for the year but since records have been kept.

Other and equally important practical results are obtained by the present invention as, for example, the desirable utilization of condensation, as the same naturally occurs when the heat of the flames F contact the relatively colder coils 35 and fins 36 of the A-coil 60. The condensation thus formed results in a film of water over the entirety of the coils 35 and the fins 36 and, thus, the heat of the flames F is not directly transferred onto the metal coils 35 and the fins 36 but rather onto the film of water which, in turn, protects the components of the A-coil 60. In other words, the film of condensation or water upon the exterior surfaces of the A-coil 60 serves as a heat exchanger and protects the A-coil 60 from heat damage. Secondly, after a summer's running of the heat exchanger 10 in the cooling mode dust collects on the A-coil and this is cleaned throughout the winter during the heat-augmenting mode by the condensation constantly running down the coils 35 and fins 36 consequently resulting in a repetitious self-cleaning cycle of the heat exchanger 10 through repetitive seasons of use.

The heat exchanger 10 does not require a defrost cycle of any type which is virtually commonplace throughout the heat pump industry.

The overall mechanical and electrical components of the heat exchanger 10 are extremely simple, and in a manual mode of operation in the absence of any type of sensing devices, the heat exchanger 10 is virtually failure-proof during its operation in the heat-augmenting mode since the only "working" parts or components are the heat source 70 and the compressor 50.

As was noted earlier, the condensation which is formed in the upper chamber portion 30 is highly beneficial and, just as importantly, the location of the electrical circuit (FIG. 5) or the components thereof in the chamber 25 prevents the circuitry from being adversely affected by such condensation with, of course, any excess condensation which collects in the pan 38 being drained to the exterior of the housing 11 in the manner readily apparent from FIG. 3.

Finally, due to the arrangement of the components 50, 60, 70 and 80 in the associated chambers, the sound level of the machine is extremely low, and though the arrangement of parts illustrated in the drawings is that preferred, modifications thereto are considered to be within the scope of this invention. For example, the blower 80 may be positioned in the chamber 25 beneath the compressor 50 to increase the efficiency during the summer or cooling mode of operation by drawing air through the vents 23 and the opening (unnumbered) at the top of the chamber 25 over the compressor 50, and into the lower chamber portion 31. Alternately, the same results can be achieved simply by reversing the direction of the rotation of the fan motor of the blower 80.

From the standpoint of new-home or new-building installations, it should be noted that since the heat exchanger 10 is the only unit necessary for all extremes of heating and cooling, any new house, office building or the like would not require a chimney, an associated flue, etc. Furthermore, though the heat exchanger 10 has been described thus far relative to being positioned outside of a building which is to be heated and/or cooled, the same may be positioned within the building so long as appropriate duct work is provided between the heat exchanger 10 and exterior ambient air. In the latter case, a chimney, flue or the like remains unnecessary because the amount of heat given off by the flames F is extremely small and is in fact less than that of a conventional home gas clothes dryer which, in most jurisdictions, need not be vented to atmosphere. However, should a code of a particular jurisdiction require the venting of gasses, such would be a simple and inexpensive proposition since virtually all of the heat from the flames F is absorbed in the heat-augmenting mode and, thus, the gasses which might necessarily have to be vented from the interior of the building to atmosphere would be cold, and the venting duct work would either not require heat-installation or the latter would be extremely minimal.

Although only a preferred embodiment of the invention has been specifically illustrated and described herein, it is to be understood that minor variations may be made in the apparatus without departing from the spirit and scope of the invention, as defined in the appended claims.

I claim:

1. A method of heating and defrosting in a heat pump system which includes at least an outside heat exchange coil defining a substantially enclosed interior chamber and an open lower end portion, an inside heat exchange coil, a compressor, an expansion valve and a refrigerant line connecting an inlet and outlet of the compressor to an outlet and inlet of the outside heat exchange coil and the inside heat exchange coil, respectively, and connecting an outlet of the inside heat exchange coil through the expansion valve to an inlet of the outside heat exchange coil comprising the steps of; operating the compressor to deliver refrigerant vapor the inside heat exchange coil; blowing air across coils of the inside heat exchange coil whereby the inside heat exchange coil functions as a condenser with the refrigerant vapor giving off its heat to air blowing across the inside heat exchange coil so that refrigerant returned to the outside heat exchange coil, after passing through the expansion valve, tends to cause the formation of frost on the outside surface of said outside heat exchange coil; creating a source of heat in the form of a flame generally contiguous and below the outside heat exchange coil and introducing the flame upwardly and substantially entirely into the interior chamber; and preventing the formation of frost on the outside heat exchange coil solely through the utilization of the created flame and in the absence of reversing the operation of the heat pump system to its cooling mode.

2. The method as defined in claim 1 wherein the heat of the open flame is substantially entirely absorbed by the refrigerant and is delivered thereby to the inside heat exchange coil.

3. The method as defined in claim 1 including the step of continuing the blowing of air across the coils of the inside heat exchange coil during the performance of the frost-preventing step.

4. The method as defined in claim 3 including the step of continuing the blowing of air across the coils of the inside heat exchange coil and continuing the open flame heating of the outside heat exchange coil after the outside heat exchange coil has been totally defrosted.

* * * * *